US007806990B2

(12) United States Patent
Tameishi et al.

(10) Patent No.: US 7,806,990 B2
(45) Date of Patent: Oct. 5, 2010

(54) DISHWASHER

(75) Inventors: Yoshimasa Tameishi, Toyoake (JP); Tomio Suyama, Toyoake (JP); Kouji Suyama, Toyoake (JP); Masumi Notsu, Toyoake (JP); Mamoru Tsumori, Toyoake (JP)

(73) Assignee: Hoshizaki Denki Kabushiki Kaisha, Aichi (JP)

( * ) Notice: Subject to any disclaimer, the term of this patent is extended or adjusted under 35 U.S.C. 154(b) by 363 days.

(21) Appl. No.: 11/913,905

(22) PCT Filed: May 16, 2006

(86) PCT No.: PCT/JP2006/309729

§ 371 (c)(1),
(2), (4) Date: Nov. 8, 2007

(87) PCT Pub. No.: WO2006/123651

PCT Pub. Date: Nov. 23, 2006

(65) Prior Publication Data

US 2009/0090402 A1 Apr. 9, 2009

(30) Foreign Application Priority Data

May 19, 2005 (JP) ..... 2005-146946

(51) Int. Cl.
*B08B 3/00* (2006.01)

(52) U.S. Cl. ..... 134/56 D

(58) Field of Classification Search ..... 134/56 D
See application file for complete search history.

(56) References Cited

U.S. PATENT DOCUMENTS

2003/0127110 A1* 7/2003 Reichold et al. ..... 134/18

FOREIGN PATENT DOCUMENTS

| | | |
|---|---|---|
| JP | 5-261053 | 10/1993 |
| JP | 5-293071 | 11/1993 |
| JP | 2001-130999 A | 5/2001 |
| JP | 2001-139099 | 5/2001 |
| JP | 2003-225191 | 8/2003 |
| JP | 2004-229808 | 8/2004 |
| WO | 96/21891 | 7/1996 |

OTHER PUBLICATIONS

Patent Abstracts of Japan, Publication No. 2001-130999, Publication Date: May 15, 2001, 1 page.
Search Report for Singapore Application No. 200708558-2 mailed May 18, 2009, 8 pages.

(Continued)

*Primary Examiner*—Michael Cleveland
*Assistant Examiner*—Samuel A Waldbaum
(74) *Attorney, Agent, or Firm*—Osha Liang LLP

(57) ABSTRACT

A dishwasher is a type in which a part of wash water contained in a wash water tank is replaced with rinse water every washing cycle. The dishwasher determines whether a present washing cycle is in timing of executing a detergent increase supply processing or in timing of executing a detergent normal supply processing (S304). Based on this determination result, by the execution of the detergent increase supply processing, a supply amount of the detergent is increased (S309). Consequently, in the dishwasher, the detergent concentration in the wash water is properly adjusted.

3 Claims, 4 Drawing Sheets

OTHER PUBLICATIONS

Translation of the International Preliminary Report on Patentability mailed Nov. 29, 2007, 5 pages.
International Search Report for PCT/JP2006/309729 mailed Jun. 6, 2006 (1 page).
esp@cenet Patent Abstract JP2001-139099 dated May 22, 2001 (1 page).
esp@cenet Patent Abstract JP2003225191 dated Aug. 12, 2003 (1 page).
Patent Abstracts of Japan 05-261053 dated Oct. 12, 1993 (1 page).
Patent Abstracts of Japan JP2004-229808 dated Aug. 19, 2004 (1 page).
Patent Abstracts of Japan 05-293071 dated Nov. 9, 1993 (1 page).

* cited by examiner

DISHWASHER

TECHNICAL FIELD

The present invention relates to a dishwasher for washing eating utensils contained in a washing chamber and more particularly, to a dishwasher of type in which a part of wash water contained in a wash water tank is replaced with supplied water every washing cycle.

BACKGROUND ART

In dishwashers, conventionally, there has been a technique of supplying a detergent to wash water based on a detection value of a sensor. For example, in a dishwasher disclosed in Patent Document 1, a detergent concentration in wash water is measured by measuring conductivity between a pair of electrodes immersed in the wash water. Further, the detergent is to be supplied into the wash water such that the detergent concentration in the wash water is constant.

Moreover, in a dishwasher disclosed in Patent Document 2, there is provided a glassy cell plate in a conduit line in which wash water flows, and a light-emitting diode and a photodiode are disposed with the cell plate sandwiched. Furthermore, light emitted from the light-emitting diode is detected by the photodiode, whereby turbidity of the wash water is measured.

[Patent Document 1] Japanese Patent Application Laid-open No. 2001-139099

[Patent Document 2] Japanese Patent Application Laid-open No. 2003-225191

DISCLOSURE OF THE INVENTION

Problem to be Solved by the Invention

In a dishwasher of type in which a part of wash water contained in a wash water tank is replaced every washing cycle, the wash water is increasingly contaminated with use. Thus, as with Patent Document 1, in the case of measuring detergent concentration in the wash water, since conductivity between the electrodes is changed depending on contamination of the wash water, there are some cases where the detergent concentration in the wash water cannot be properly adjusted.

Furthermore, as with Patent Document 2, in the case of using the light-emitting diode and the photodiode, when contaminating materials in the wash water stick to the cell plate, the turbidity of the wash water cannot be measured. Therefore, even if such a sensor is used, there are some cases where the detergent concentration in the wash water cannot be properly adjusted.

The present invention has an object of properly adjusting a detergent concentration in wash water in a dishwasher.

Means for Solving the Problem

To achieve the above-described object, the present invention is a dishwasher of a type which is constructed such that eating utensils are washed by wash water contained in a wash water tank, and the wash water after washing is collected into the wash water tank, and in which a part of the wash water contained in the wash water tank is replaced with a supplied water every washing cycle, wherein there is provided a detergent supply device supplying the detergent to the wash water, and this detergent supply device increases a supply amount of the detergent based on the number of times of the washing cycle.

Owing to such construction, since the supply amount of a detergent is increased based on the number of times of washing cycles, the supply amount of the detergent is not affected by the contamination of the wash water. Consequently, the detergent concentration in the wash water is adjusted to be at a detergent concentration appropriate for washing eating utensils, thus enabling to conduct the supply of the detergent to the wash water without loss.

EFFECTS OF THE INVENTION

According to the present invention, in a dishwasher, a detergent concentration in wash water can be properly adjusted.

EXPLANATION OF REFERENCE NUMERALS

Figure 1:
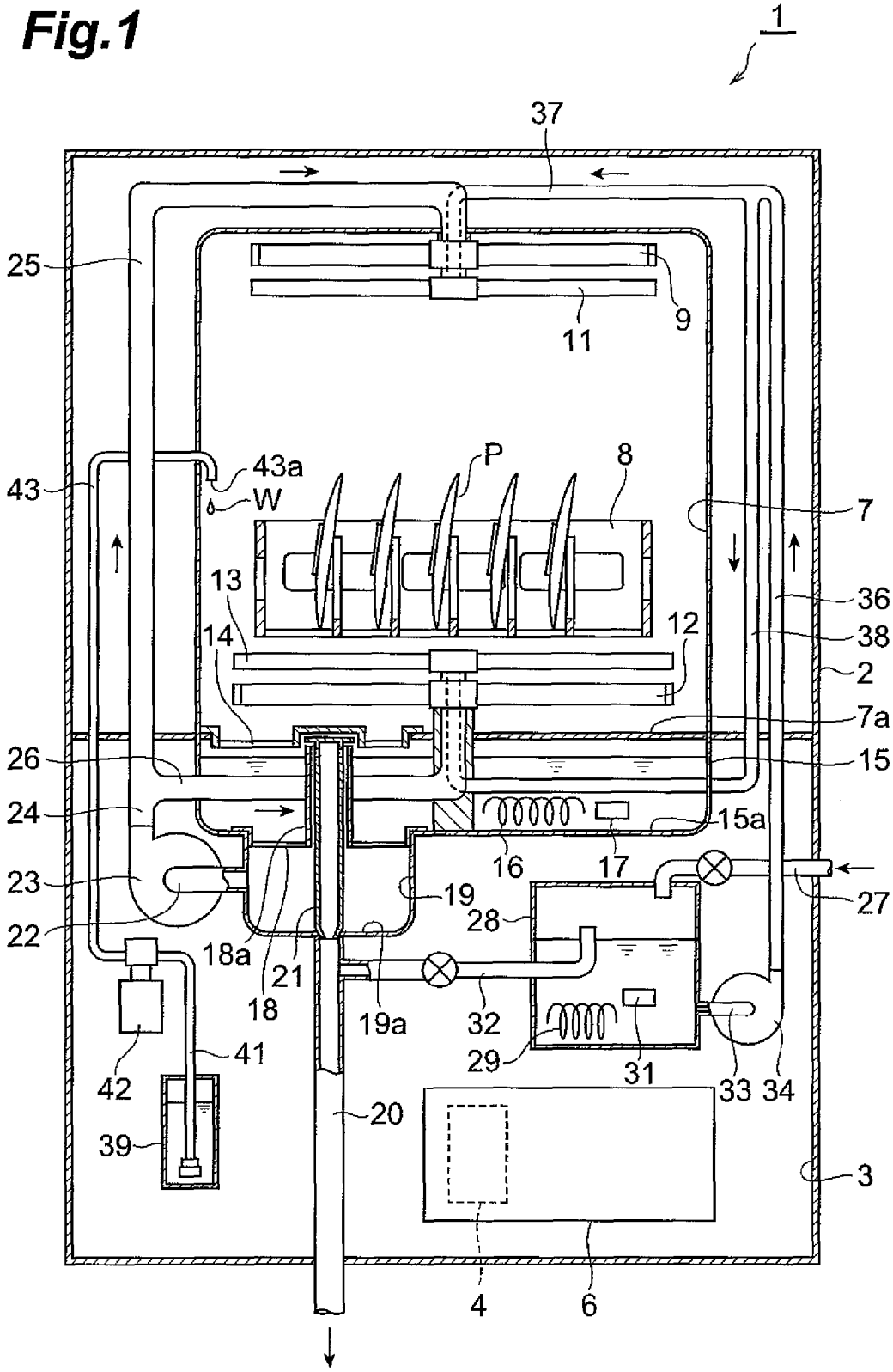
FIG. 1 is a sectional view illustrating a dishwasher according to an exemplary embodiment of the present invention.

1: dishwasher, 2: main body case, 3: machine chamber, 4: microcomputer, 5: control panel, 6: electric box, 7: washing chamber, 8: dish rack, 9, 12: washing nozzle, 11, 13: rinsing nozzle, 14: filter, 15: wash water tank, 23: wash water supply pump, 28: rinse water tank, 34: rinse water supply pump, 39: detergent tank, 42: detergent supply pump, 45: washing control function, 46: rinsing control function, 47: detergent supply function, 47*b*: detergent increase supply function, 47*a*: detergent normal supply function, 48: detergent increase supply timing setting function

BEST MODES FOR CARRYING INVENTION

Hereinafter, referring to the drawings, a dishwasher according to an exemplary embodiment of the present invention will be described.

As illustrated in FIG. 1, a dishwasher 1 includes a stainless main body case 2 divided into upper and lower portions. There is provided at a lower portion of this main body case 2 a machine chamber 3, and an electric box 6 in which a microcomputer (controller) 4 that controls the entire operation of the dishwasher 1 is contained is housed. On the other hand, a washing chamber 7 is formed at the upper portion of the main body case 2, as well as a door (not illustrated) that vertically moves in order to open and closed this washing chamber 7 is attached.

In this washing chamber 7, a rack rail (not illustrated) is removably located, and on this rack rail, a grid of a dish rack 8 on which eating utensils P such as dishes or cups after eating are placed. Furthermore, at the upper portion of the washing chamber 7, an upper washing nozzle 9 formed of three arms radially extended and an upper rinsing nozzle 11 linearly extended are disposed rotatably about the same axis. Likewise, at the lower portion of the washing chamber 7, a lower washing nozzle 12 formed of three arms radially extended and a lower rinsing nozzle 13 linearly extended are disposed rotatably about the same axis. Thus, the eating utensils P arranged in the dish rack 8, since being sprayed with wash water from above and below with the washing nozzles 9 and 12 and being sprayed with rinse water from above and below with the rinsing nozzles 11 and 13, the eating utensils P are efficiently washed and rinsed.

At a bottom face 7*a* of the washing chamber 7 constructed in such a way, a first filter 14 is removably located, and a wash water tank 15 for containing wash water is formed below this first filter 14. In this wash water tank 15, there are located a wash water heater 16 for maintaining the wash water, being a warn water at a predetermined temperature, and a wash water temperature sensor 17 for detecting the temperature of this wash water.

Furthermore, in a bottom face 15*a* of the wash water tank 15, a second filter 18 of a finer mesh than that of the first filter 14 is removably disposed, and below this second filter 18, a depression 19 is formed in such a manner that a part of the bottom face 15*a* is pressed. A drainpipe 20 is connected to a bottom face 19*a* of this depression 19, and a lower end portion of an overflow pipe 21 which goes through a tubular portion 18*a* of the second filter 18, and which upper end portion is positioned in the wash water tank 15 is fit to this drainpipe 20. Therefore, since excess wash water flows into the tube through an inlet port that is formed at the upper end portion of the overflow pipe 21, and is discharged to the outside through the drainpipe 20, the wash water in the wash water tank 15 is kept at a constant water level.

A wash water supply pump 23 is connected to this depression 19 of the wash water tank 15 via a wash water suction pipe 22. A wash water discharge pipe 24 is connected to an outlet of this wash water supply pump 23; and this wash water discharge pipe 24 is diverged into a first wash water discharge pipe 25 and a second wash water discharge pipe 26, and the first wash water discharge pipe 25 is connected to the upper washing nozzle 9 and the second wash water discharge pipe 26 is connected to the lower washing nozzle 12.

Furthermore, there is located in the machine chamber 3 a rinse water tank 28 to which rinse water is supplied externally from a hot-water supply system (not illustrated) through a hot-water supply pipe 27. In this rinse water tank 28, there are provided a rinse water heater 29 for maintaining the rinse water, being warm water at a predetermined temperature, and a rinse water temperature sensor 31 for detecting the temperature of this rinse water. Moreover, there is located in this rinse water tank 28 an overflow pipe 32 for discharging excess rinse water to the outside to keep the rinse water at a predetermined water level, and the rinse water that flows in the pipe from an upper end thereof is discharged to the outside through the drainpipe 20.

A rinse water supply pump 34 is connected to this rinse water tank 28 via a rinse water suction pipe 33. A rinse water discharge pipe 36 is connected to an outlet of this rinse water supply pump 34; and this rinse water discharge pipe 36 is diverged into a first rinse water discharge pipe 37 and a second rinse water discharger pipe 38, and the first rinse water discharge pipe 37 is connected to the upper rinsing nozzle 11 and the second rinse water discharge pipe 38 is connected to the lower rinsing nozzle 13.

Furthermore, in the machine chamber 3, a detergent tank 39 in which a liquid-type or a powder-type detergent W to be mixed in the wash water in the wash water tank 15 is disposed. A detergent supply pump (detergent supply device) 42 is connected to this detergent tank 39 via a detergent suction pipe 41. One end of a detergent discharge pipe 43 is connected to an outlet of this detergent supply pump 42, and the other end 43*a* of this detergent discharge pipe 43 is positioned in the washing chamber 7 to be open downward.

Here, the operation of the above-described dishwasher 1 will be described. When an operation start button is pressed, a washing start signal is transmitted from the microcomputer (hereinafter, referred to as "mi-com"), and thus the wash water supply pump 23 is started. Whereby, the wash water contained in the wash water tank 15 is supplied under pressure to the upper and lower washing nozzles 9 and 12 through the wash water discharge pipe 24 and the like, to be sprayed toward eating utensils P from each of the washing nozzles 9 and 12. At this time, since each of the washing nozzles 9 and 12 continues to rotate by a reaction force of the jet force, the wash water is uniformly applied to the eating utensils P, and thus contaminating materials of the eating utensils P are efficiently washed off.

The wash water having been sprayed onto these eating utensils P is collected into the wash water tank 15 while contaminating materials such as vegetables having been washed off from the eating utensils P are being removed through the first filter 14. Furthermore, after fine contaminating materials have been removed with the second filter 18, the wash water is circulated to be supplied into the washing chamber 7 by means of the wash water supply pump 23 again.

When such a washing process is conducted for a predetermined time period, a washing end signal is output form the mi-com 4 and thus the wash water supply pump 23 is stopped, and a rinsing start signal is output from the mi-com 4 and thus the rinse water supply pump 34 is started. With the arrangement, the rinse water contained in the rinse water tank 28 is supplied under pressure to the upper and lower rinsing nozzles 11 and 13 via the rinse water discharge pipe 36 and the like, and sprayed toward the eating utensils P from each of the rinsing nozzles 11 and 13. At this time, since each of the rinsing nozzles 11 and 13 also continues to rotate by a reaction force of the jet force, the rinse water is uniformly applied to the eating utensils P, and thus the eating utensils P are efficiently rinsed.

The rinse water having been sprayed to these eating utensils P is collected into the wash water tank 15 through the first filter 14. Accompanied thereby, the wash water of the same amount as that of the rinse water having been collected is discharged to the outside from the overflow pipe 21 through the drainpipe 20. The rinse water having been collected in the wash water tank 15 is mixed with the wash water, and is used as wash water in the next washing process. When such a rinsing process is conducted for a predetermined time period, a rinsing end signal is output from the mi-com 4 and thus the rinse water pump 23 is stopped, and the operation of one cycle of the dishwasher 1 has completed. Incidentally, according to this embodiment, as described above, by the collection of the rinse water in the wash water tank 15, water is supplied to the wash water tank 15, and a part of the wash water is replaced; while, in another embodiment, water may be directly supplied into the wash water tank 15 from a water supply piping, and a part of the wash water may be replaced.

In the above-described rinsing process, the detergent W that is contained in the detergent tank 39 is supplied under pressure in the detergent discharge pipe 43 by means of the detergent supply pump 42 to be dripped into the washing chamber 7 from the other end 43*a* of the detergent discharge pipe 43. This detergent W having been dripped is mixed with the rinse water, and will flow into the wash water tank 15. The reason of newly supplying the detergent W into the wash water tank 15 in such a manner is to prevent the detergent concentration in the wash water from being reduced due to that the rinse water flows in the wash water tank 15.

Figure 2:
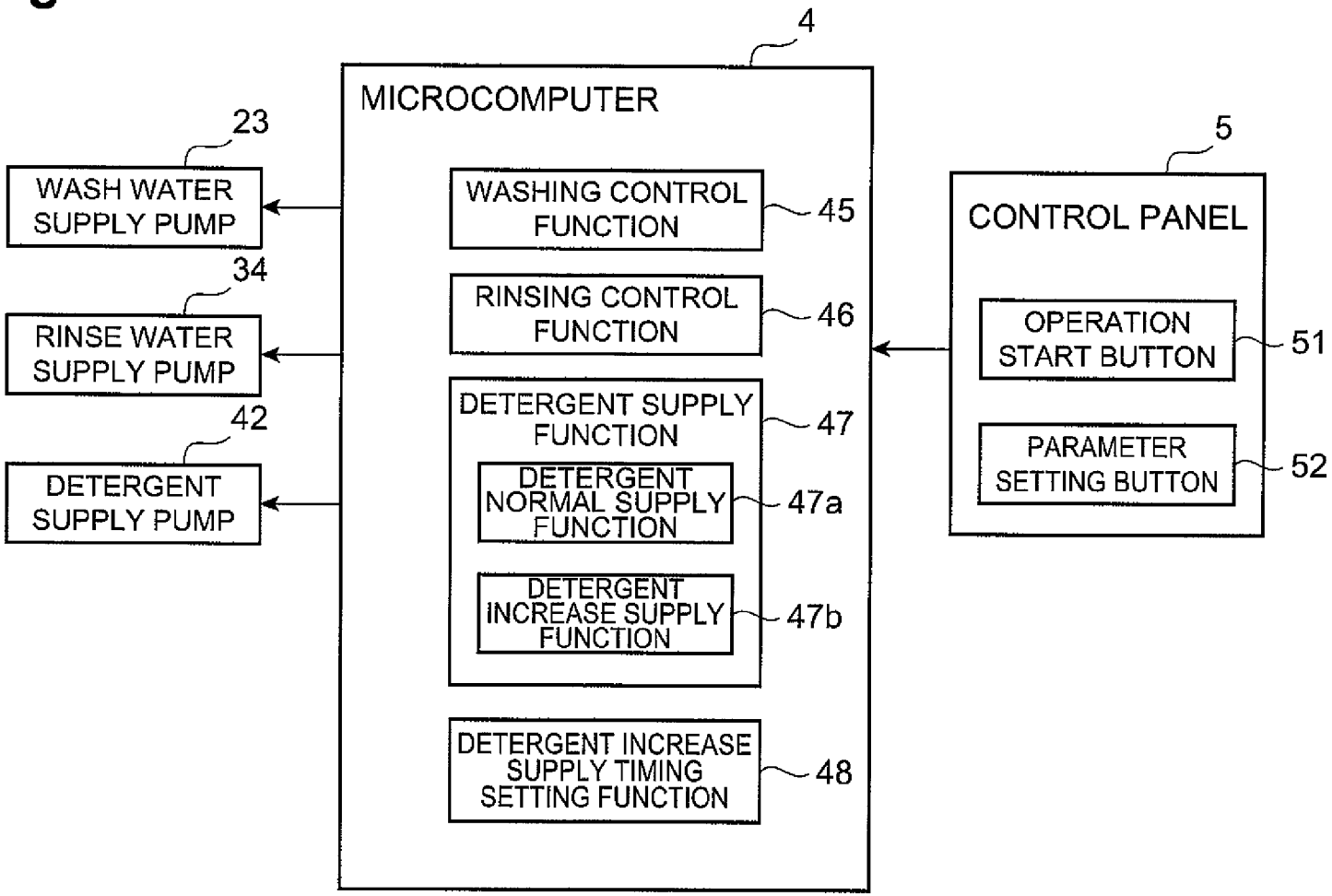
FIG. 2 is a block diagram of the dishwasher.

FIG. 2 illustrates each device for executing a washing processing in the dishwasher 1. In the dishwasher 1, when a user operates the control panel 5, based thereon, the mi-com 4 causes various pumps 23, 34, and 42 to operate. Such processing of the dishwasher 1 will be described in detail.

There is provided at the control panel 5 an operation start button 51. The mi-com 4 includes a washing control function 45, a rinsing control function 46 and a detergent supply function 47; when the operation start button 51 of the control panel 5 is pressed, the washing control function 45 causes the wash water supply pump 23 to operate for a predetermined time period, and thereafter the rinsing control function 46 causes the rinse water supply pump 34 to operate for a predetermined time period. Furthermore, the detergent supply function 47 causes the detergent supply pump to operate in synchronism with the operation of the rinse water supply pump 34.

Incidentally, the detergent supply function 47 includes a detergent normal supply function 47*a* and a detergent increase supply function 47*b*. The detergent normal supply function 47*a* causes the detergent supply pump 42 to operate, and executes a processing of supplying a normal amount of the detergent having preliminarily been determined. Hereinafter, this processing is referred to as a detergent normal supply processing. The detergent increase supply function 47*b* causes the detergent supply pump 42 to operate, and executes a processing of supplying the detergent of more than the above-mentioned normal amount into the wash water. Hereinafter, this processing is referred to as a detergent increase supply processing.

Moreover, at the control panel 5, in addition to the operation start button 51, there is provided a parameter setting button 52 with which a user arbitrarily sets the operation of the dishwasher 1. The mi-com 4 includes a detergent increase supply timing setting function 48, and when the parameter setting button 52 of the control panel 5 is operated by a user, and thus a parameter S1, S2 a user desires is registered, the detergent increase supply timing setting function 48 fetches and holds the registered parameter S1, S2. The method of using the registered parameter S1, S2 will be described in detail. Incidentally, a variety of functions of the mi-com 4 are conducted by the execution of a program of the mi-com 4.

Figure 3:
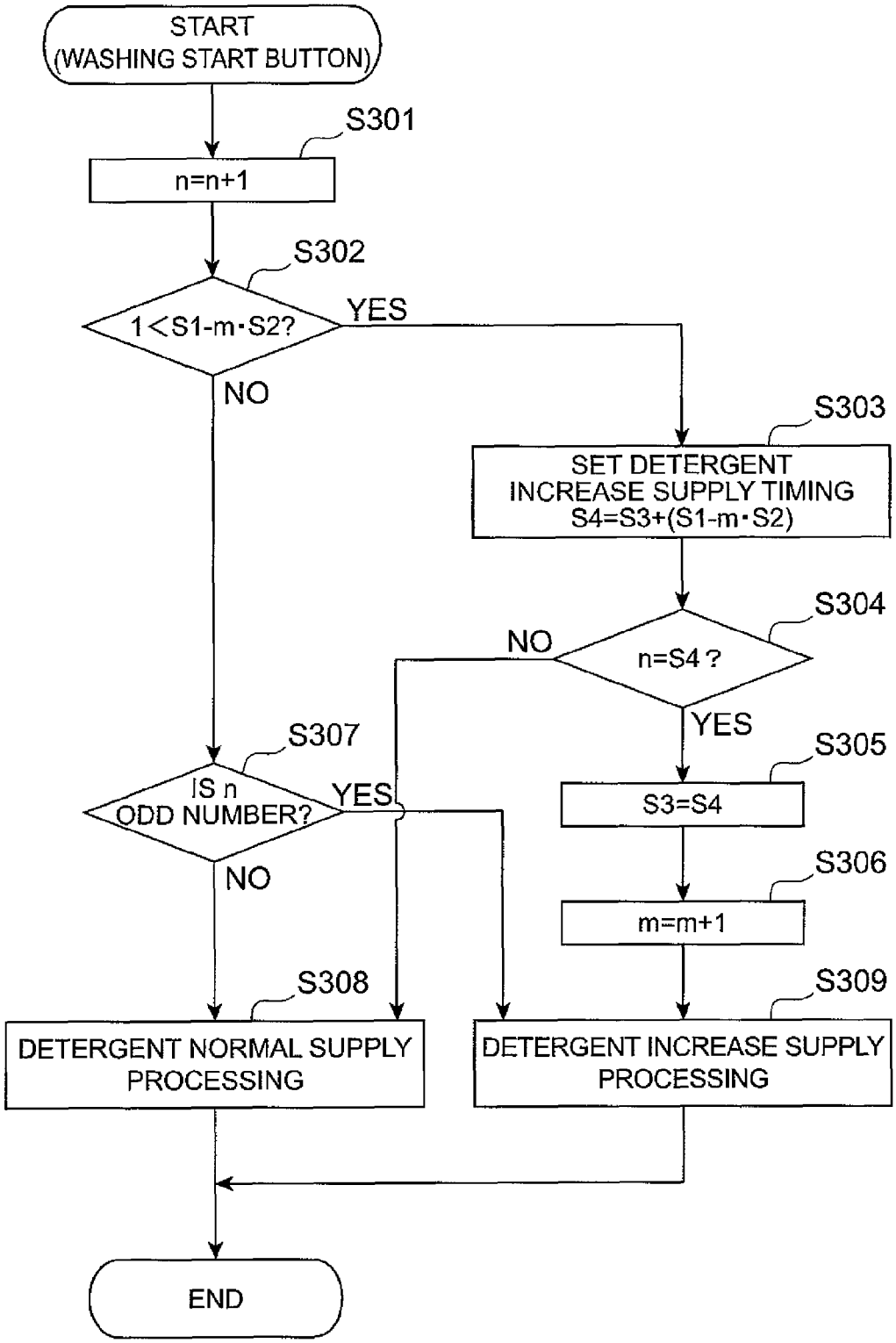
FIG. 3 is a flowchart illustrating a detergent supply processing using the dishwasher.

Now, a detergent supply processing by means of the mi-com 4 will be described. In FIG. 3, a flowchart of the detergent supply processing is shown. The detergent supply processing of FIG. 3 is executed in the middle of a rinsing process in each washing cycle.

Before describing a specific processing, six parameters m, n, S1, S2, S3 and S4 for use in the detergent supply processing are described. The parameter n is a parameter representing the number of times of a present washing cycle. The parameter m is a parameter representing the number of times of executed detergent increase supply processing. The parameters S1, S2, S3 and S4 are parameters for determining a washing cycle in which the detergent increase supply processing has to be executed. In specific, the parameter S1 is a parameter representing the first detergent increase supply timing. The parameter S2 is a parameter for adjusting the second detergent increase supply timing and thereafter. The parameters S3 and S4, for reasons of convenience of a computation processing, are parameters to be substituted for a calculated detergent increase supply timing. As described above, the parameters S1 and S2 are set to be arbitrary values by a user by the operation of the parameter setting button 52 by the user. On the other hand, initial values of the parameters m, n, S3 and S4 are set to be zero.

The mi-com 4 first increments the parameter n representing the number of times of washing cycles (S301), and then determines whether a detergent concentration in the wash water has reached a threshold value (S302). In specific, the mi-com 4 makes a determination based on a Formula 1. According to the Formula 1, a value of {S1−m·S2} expresses the number of cycles of washing cycles from the last detergent increase supply processing to the next detergent increase supply processing. Therefore, supposing that this number of cycles is not less than two, since the frequency of detergent increase supply processing is low and thus the detergent concentration in the wash water has not reached a threshold value, the program goes to Step 303. On the other hand, supposing that this number of cycles is once, since the frequency of detergent increase supply processing is high and thus the detergent concentration in the wash water has reached a threshold value, the program goes to Step 307.

$$1<S1-m\cdot S2 \quad \text{(Formula 1)}$$

The mi-com 4, in the case where the detergent concentration in the wash water is determined not to have reached the threshold value, subsequently calculates a washing cycle S4 in which the next detergent increase supply processing has to be executed (S303), and determines whether the detergent increase supply processing has to be executed in a present cycle or not (S304). In specific, the mi-com 4, based on an Formula 2, calculates the washing cycle S4 in which the detergent increase supply processing has to be executed, and determines whether or not the parameter n presenting the number of times of the present cycle is the washing cycle S4 having been calculated. According to the Formula 2, since it is determined based on the number of times of washing cycles whether the detergent increase supply processing has to be executed or not, a supply amount of the detergent is not affected by the contamination of the wash water.

$$S4=S3+(S1-m\cdot S2) \quad \text{(Formula 2)}$$

Here, in the case where the parameter n representing the number of times of the present cycle is not the washing cycle S4 in which the detergent increase supply processing has to be executed, the mi-com 4 outputs an instruction for executing the detergent normal supply processing to the detergent supply pump 42. With the arrangement, the detergent supply pump 42 is operated, and a normal amount of the detergent is supplied into the wash water (S308). Then, the detergent supply processing is ended.

On the other hand, in the case where the parameter n representing the number of times of the present cycle is the washing cycle S4 in which the detergent increase supply processing has to be executed, the mi-com 4 substitutes the parameter S4 for the parameter S3 (S305), increments the parameter m representing the number of times of having executed the detergent increase supply processing (S306), and then outputs an instruction for executing the detergent increase supply processing to the detergent supply pump 42. Whereby, the detergent supply pump 42 is operated, and the detergent of twice the normal amount is supplied into the wash water (S309). Then, the detergent supply processing is ended.

The mi-com 4, in the case where the detergent concentration in the wash water is determined to have reached the threshold value in Step 302, repeats the detergent normal supply processing and the detergent increase supply processing such that the detergent concentration in the wash water is kept to be constant. In specific, the mi-com 4 determines whether the parameter n representing the number of times of the present cycle is an odd number or not (S307); in the case where the parameter n is an odd number, the detergent increase supply processing is executed (S309), and in the case where the parameter n is an even number, the detergent normal supply processing is executed (S308). With the arrangement, by repeating the detergent increase supply processing and the detergent normal supply processing every washing cycle, the detergent concentration in the wash water is kept to be a constant value.

In the above-described detergent supply processing, an initial value of the parameters m and n is zero, and in the case of being incremented in the above-described processing, this incremented parameter is held and used in the next detergent supply processing. Incidentally, the parameters m and n having been incremented are reset to be an initial value, zero when the wash water contained in the wash water tank 15 is fully replaced. As a resetting means, it is preferable that there be provided at a control panel a reset switch.

According to the above-described detergent supply processing, every time the parameter n representing the number of times of a present cycle is the washing cycle S4 in which the detergent increase supply processing has to be executed and the detergent increase supply processing is executed, the detergent concentration in the wash water is increased. Assuming that only the normal amount of the detergent is supplied even if a washing cycle proceeds, as the washing cycle proceeds, the wash water comes to be contaminated, resulting in a reduced detergency. Whereas, as described above, in case where the detergent concentration in the wash water is increased as the washing cycle proceeds, the detergency having be reduced due to the contamination of the wash water can be made higher with the detergency of the detergent. Such an effect of detergent supply processing according to this embodiment will be described with a specific example.

In a specific example described hereinafter, 20 litters of a wash water is contained in the wash water tank 15, and when the wash water is fully replaced, a detergent is supplied into the wash water such that the detergent concentration is 0.10%. In addition, in a rinsing process of one washing cycle, two liters of rinse water is used, and two liters of this rinse water is replaced with the wash water contained in the wash water tank 15. Furthermore, in one detergent normal supply processing, two grams of detergent of a normal amount is supplied to the wash water. In addition, the setting parameter S1 is set to be 10 cycles, and the setting parameter S2 is set to be one cycle.

Since the parameter m is zero until the first detergent increase supply processing is executed, the washing cycle S4 in which the first detergent increase supply processing has to be executed is found to be the tenth washing cycle by the calculation of the Formula 2. Therefore, in the first to ninth washing cycles, the detergent normal supply processing is executed, and in the tenth washing cycle, the detergent increase supply processing is executed. When the detergent increase supply processing is executed, the parameter m is incremented to be one.

In the case where the parameter m comes to be one, the washing cycle S4 in which the second detergent increase supply processing has to be executed is found to be the nineteenth washing cycle by the calculation of the Formula 2. Therefore, in the eleventh to eighteenth washing cycles, the detergent normal supply processing is executed, and in the nineteenth washing cycle, the detergent increase supply processing is executed. When the detergent increase supply processing is executed, the parameter m is incremented to be two. Thereafter, likewise, in the 27th, 34th, 40th, 45th, 49th, 52nd, 54th, and 55th washing cycles, the detergent increase supply processing is executed, the detergent concentration in the wash water is increased by degrees, and in the 55th washing cycle, the detergent concentration will reach 0.15%, being a threshold value. Furthermore, in the 56th washing cycle and thereafter, the detergent normal supply processing and the detergent increase supply processing are repeated alternately and the detergent concentration is kept to be approximately at 0.15%.

Figure 4:
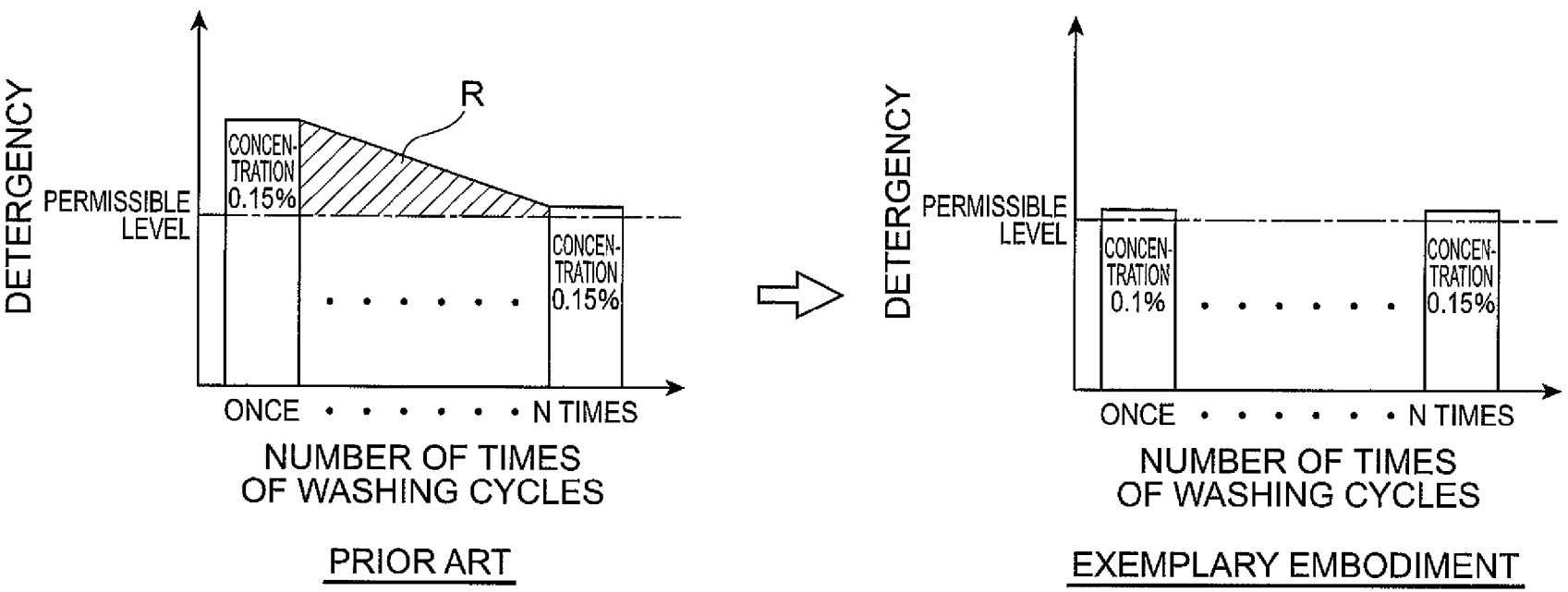
FIG. 4 is a graph for illustrating the effect of this embodiment.

With reference to FIG. 4, effects of the above-described detergent supply processing will be described. On the left side of FIG. 4, the change of the detergency of a detergent in the case of conducting a detergent supply method of a prior art is shown. In the prior art, since only a normal amount of the detergent is supplied to the wash water contained in the wash water tank 15 at all times, the detergent concentration is not changed even if a washing cycle proceeds. Thus, to prevent the decrease of the detergency due to the contamination of the wash water, the detergent concentration in the wash water is increased to be 0.15%, thus preventing insufficiency in the detergency. By this method, in a region R, being the diagonally shaded area in FIG. 4, the detergency of the wash water is shown to be excessive, and thus the detergent is found to be used wastefully.

Whereas, on the right side of FIG. 4, the change of the detergency of the detergent in the case of conducting the detergent supply method according to this embodiment is shown. In this embodiment, since the detergent of twice a normal amount is supplied to the wash water contained in the wash water tank 15, the detergent concentration is increased as a washing cycle proceeds. With this arrangement, the detergent concentration in the wash water is first to be 0.10%, and the detergent concentration is increased to be 0.15% as a washing cycle proceeds. Consequently, the detergency of the wash water is neither excessive nor insufficient, and a wasteful use of the detergent can be prevented.

Meanwhile, as described above, two setting parameters S1 and S2 are arranged so as to be capable of being set to be arbitrary values by the operation of the control panel 5 of a user. With the arrangement, these two setting parameters S1 and S2 can be arbitrarily set, thereby enabling to cope with contamination degree of the wash water.

For example, in the case where the dishwasher 1 is used in a Japanese food restaurant and the like, since eating utensils are comparatively less soiled, the increase of contamination of the wash water is small every washing cycle. In these situations, by setting the parameter S1 to be a large value, and by setting the parameter S2 to be a small value, the detergent increase supply processing may be executed less frequently. Whereby, too much detergent is not wastefully supplied to the wash water, and thus the use of an excess detergent can be prevented.

On the other hand, in the case where the dishwasher 1 is used in a Chinese food restaurant and the like, since eating utensils are comparatively more soiled, the increase of contamination of the wash water is large every washing cycle. In these situations, by setting the parameter S1 to be a small value, and by setting the parameter S2 to be a large value, the detergent increase supply processing may be executed more frequently. Whereby, much detergent is supplied to the wash water, and thus the insufficiency of detergency can be prevented.

Incidentally, in the above-described embodiment, based on the number of times of washing cycles, it is determined whether a normal amount of the detergent is supplied or the detergent of twice the normal amount is supplied, and thus a supply amount of the detergent is to be increased. However, the method of increasing the supply amount of the detergent based on the number of times of washing cycles is not limited to this method. For example, it is preferable that based on the number of times of washing cycles, the amount of the detergent to be supplied to the wash water be gradually increased every washing cycle.

Furthermore, although in the above-described embodiment, the function of gradually increasing the supply amount of the detergent is described, the dishwasher 1 may be arranged so as to be capable of switching this function to be active or inactive by a user.

The invention claimed is:

1. A dishwasher comprising:

a wash chamber configured to contain eating utensils;

a wash water tank configured to contain wash water;

wherein the eating utensils are washed by the wash water contained in the wash water tank, wherein the wash water, after washing, is collected into the wash water tank, and wherein a part of the wash water contained in the wash water tank is replaced with supplied water at every washing cycle of a plurality of washing cycles;

a detergent supply device configured to supply a detergent to the wash water; and, a microcomputer storing a program capable of causing the microcomputer to perform:

controlling a start and a stop of each consecutive washing cycle of the plurality of washing cycles;

counting a number of times consecutive washing cycles have been performed;

storing a predetermined set of parameters that define an amount of the detergent to be supplied to the wash water given the number of times consecutive washing cycles have been performed so as to maintain a desired concentration of detergent in the wash water;

determining, at every washing cycle of the plurality of washing cycles, an amount of the detergent to be supplied to the wash water exclusively based on the number of times consecutive washing cycles have been performed and the predetermined set of parameters; and controlling the detergent supply device to supply the determined amount of the detergent to the wash water at every washing cycle of the plurality of washing cycles, wherein the predetermined set of parameters define an increasing amount of detergent from an initial washing cycle to each consecutive washing cycle in the plurality of cycles.

2. The dishwasher of claim 1, wherein the predetermined set of parameters define an increase in a supply frequency of the detergent given the number of times consecutive washing cycles have been performed.

3. The dishwasher of claim 1, wherein the predetermined set of parameters define an increase in the amount of the detergent to be supplied to the wash water at one time given the number of times consecutive washing cycles have been performed.

* * * * *